US005687670A

United States Patent [19]

Rice, IV

[11] Patent Number: 5,687,670

[45] Date of Patent: Nov. 18, 1997

[54] CIRCUMFERENTIAL CIRCULATION CONTROL SYSTEM

[75] Inventor: James Q. Rice, IV, Newport, R.I.

[73] Assignee: The United States of America as represented by the Secretary of the Navy, Washington, D.C.

[21] Appl. No.: 605,315

[22] Filed: Feb. 7, 1996

[51] Int. Cl.[6] ..... B63G 8/08

[52] U.S. Cl. ..... 114/312; 114/337; 114/338; 114/151; 440/38

[58] Field of Search ..... 114/151, 337, 114/338, 330, 331, 277, 278, 312; 440/38

[56] References Cited

U.S. PATENT DOCUMENTS 3,209,714 10/1965 Bowles ..... 114/277

3,675,424 7/1972 Oosterveld ..... 114/151

4,424,042 1/1984 Gongwer ..... 114/338

5,438,947 8/1995 Tam ..... 114/337

*Primary Examiner*—Jesus D. Sotelo

*Attorney, Agent, or Firm*—Michael J. McGowan; James M. Kasischke; Prithvi C. Lall

[57] ABSTRACT

Disclosed is a device used to maneuver a vehicle consisting of a tubular body with suction circumferential slots adjacent its forward end and exhaust circumferential slots adjacent its aft end on both the outer and inner peripheral surfaces. Fluid is conveyed between the forward slots on one surface of the tubular body to the aft slots on the other surface of the body to produce asymmetrical pressure on the tubular body while traveling through a fluid medium.

19 Claims, 2 Drawing Sheets

CIRCUMFERENTIAL CIRCULATION CONTROL SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to submersible vehicles and, more particularly, to control systems useful in the maneuvering of unmanned undersea vehicles (UUVs).

(2) Brief Description of the Prior Art

During the history of submersible vehicles, designers have often used movable appendages for vehicular control. Although this method of control works well at high speeds, the drag and noise created by these appendages is often not desirable. In addition, the usefulness of these movable appendages decreases significantly as the fluid velocity decreases. Movable appendages are currently used on most submerged vehicle ranging from submarines to torpedoes.

In recent designs, thruster pods have been used to increase vehicle maneuverability at low speeds. These thrusters are sometimes mounted on swivels external to the vehicle body to allow optimum thrust and torque to be transferred to the vehicle. This type of application is often seen on deep diving vehicles known in the art as autonomous undersea vehicles (AUVs). The external mounting of such thrusters increases the difficulty in vehicle handling and is not conductive to vehicle launching from a submarine launch tube.

Therefore, a need exists for a control system which provides quick response and quiet maneuvering of a UUV and other submersible vehicles.

SUMMARY OF THE INVENTION

Accordingly, a first object of the subject invention is the provision of a control system for maneuvering an undersea vehicle.

Another object of the current invention is the provision of such a maneuvering system having the capability of maneuvering the vehicle at low speeds.

Yet another object of this invention is the provision of a maneuvering system that does not interfere with the launch of a vehicle from a submarine launch tube.

The present invention includes a cylindrical tubular body having a longitudinal axis and outer and inner peripheral sides. The maneuvering jets are circumferentially arranged on the tubular body for conveying fluid between said outer and inner peripheral surfaces. Maneuvering jets produce unbalanced pressure on the tubular body about the body's longitudinal axis. The maneuvering jets include a plurality of fluid exhaust slots circumferentially arranged adjacent the body aft end on the outer peripheral surface of the body and a plurality of fluid exhaust slots circumferentially arranged adjacent the body aft end on the inner peripheral surface. There are also a plurality of forward fluid suction slots circumferentially arranged on the body's outer peripheral surface and a plurality of forward fluid suction slots circumferentially arranged on the body's inner peripheral surface. Conduits inside the tubular body connect the fluid exhaust slots adjacent the aft end on the body's outer peripheral surface with the fluid suction slots positioned toward the forward end on the body's inner peripheral surface. Likewise, conduits also connect the fluid exhaust slots adjacent the aft end on the body's inner peripheral surface with the fluid suction slots positioned toward the body's forward end on the outer peripheral surface. The fluid conveying means described above are preferably housed in a separable tubular end-piece joined to the tubular body with the end-piece having eight circumferential slots in its inner surface and eight circumferential slots in its outer surface. A conduit or passageway connects each inner slot in the end-piece with a corresponding outer slot so that a pump may pump fluid from the inner slot to the outer slot or from the outer slot to the inner slot. Preferably, the tubular end-piece has eight circumferentially arranged control regions, each control region having a pump mounted therein. A flow control valve is provided in each of the four conduits to allow fluid to flow from the inner surface to the outer surface or from the outer surface to the inner surface.

The present invention uses the slots, pumps and valves described above to provide maneuvering control by changing the location of the rear stagnation point around predetermined circumferential sections of the body. This action changes the stagnation line around the body circumference from an axisymmetric distribution to a non-axisymmetric distribution, thus producing non-axisymmetric pressures on the duct or body which result on forces allowing the vehicle to be maneuvered.

The present invention applies this method of vehicular control to a hollow bodied UUV for enhanced maneuvering control at low speeds and for quiet operations. The method can eliminate the need for any type of ballast system to be carried by the UUV.

Pumping fluids into the boundary layer in an axisymmetric fashion using slots can reduce or eliminate duct separation. The method of the present invention involves sucking fluid from the boundary layer on one side of the duct surface and pumping it into the boundary layer on the other side of the duct, i.e. pumping fluid in a non-axisymmetric fashion to produce non-axisymmetric forces on the duct and facilitate the execution of controlled maneuvers.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DETAILED DESCRIPTION OF THE PREFERRED EMBODIMENT

Figure 2:
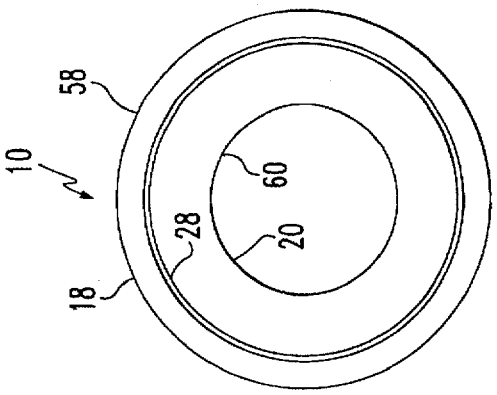
FIG. 2 is an aft end view of the device shown in FIG. 1.
Figure 1:
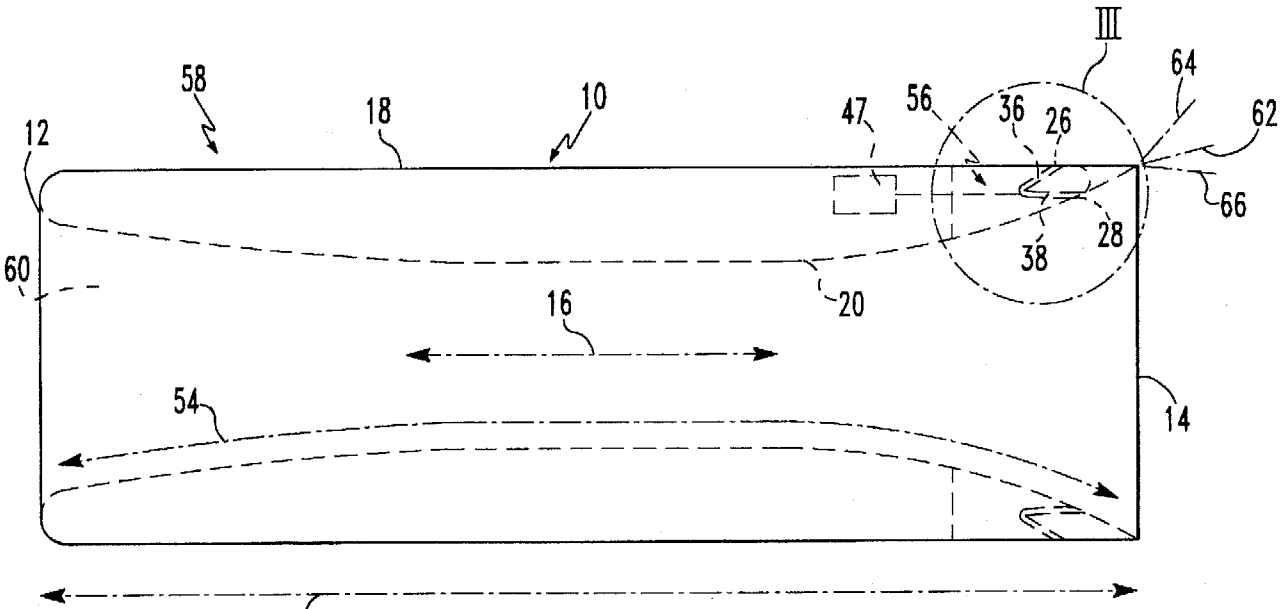
FIG. 1 is a side elevational view of a preferred embodiment of the inventive device.
Figure 3:
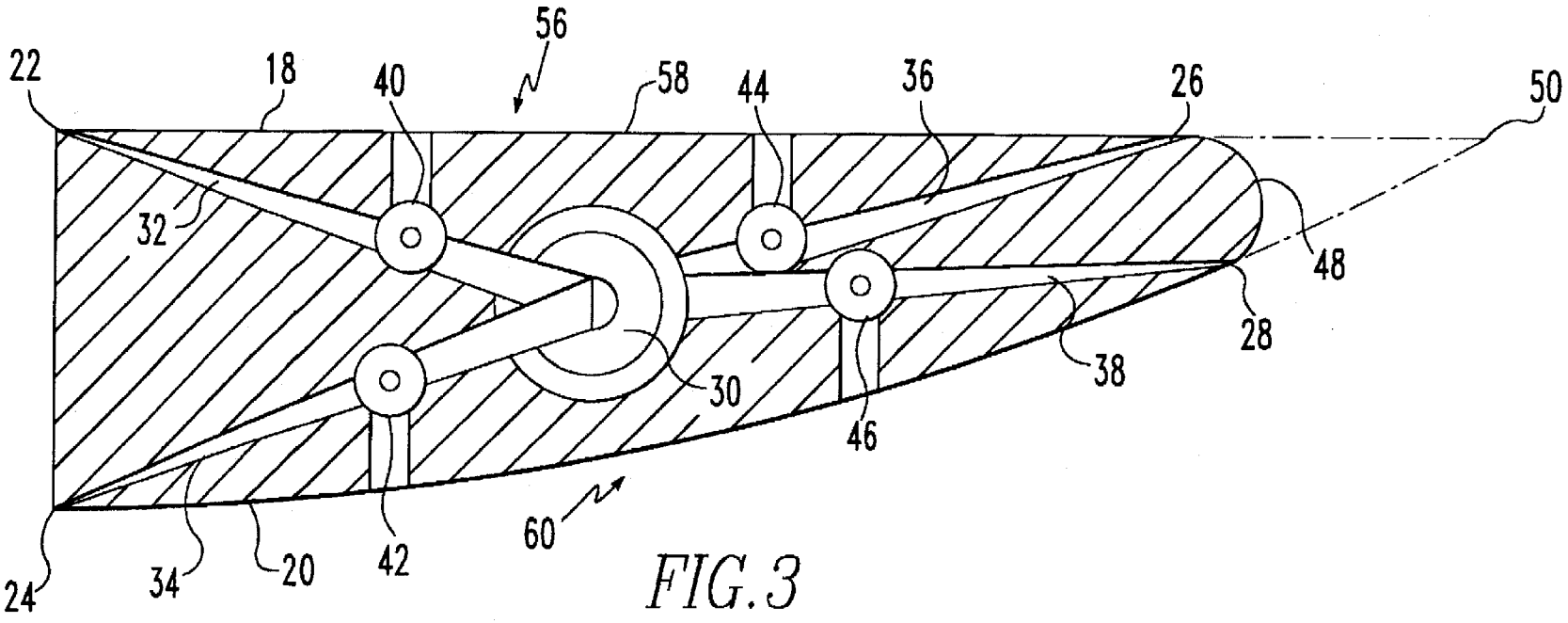
FIG. 3 is an enlarged cross-sectional view of the area within circle III in FIG. 1.

Referring to the drawings, the device of the present invention includes a tubular body shown generally at numeral 10 which has a forward end 12, an aft end 14 and a longitudinal axis 16. This tubular body also includes an outer peripheral surface 18 and an inner peripheral surface 20. Referring particularly to FIG. 3, there are on the outer peripheral surface 18 of the tubular body 10 a circumferential pattern of forward suction slots as at 22. On the inner peripheral surface 20 of the tubular body 10 there are a similar number of forward inner suction slots as at 24 which are also circumferentially arranged. On the outer surface 18 there is also a circumferential pattern of aft exhaust slots as at 26. Similarly, on the inner surface 20 there is a circumferential pattern of aft inner exhaust slots 28 and within the tubular body 10 there is a pump 30 for each of the eight circumferential sections. The forward outer suction slots 22 are connected with pump 30 via a first conduit group 32. The forward inner suction slots 24 are connected with pump 30 via a second conduit group 34. The pump 30 is also connected to the aft outer exhaust slots 26 via a third conduit group 36. The pump 30 is connected with the aft inner exhaust slots 28 with a fourth conduit group 38. Between the forward outer suction slots 22 and the pump 30 on the first conduit 32, there is a first control valve 40. Between the forward inner suction slot 24 and the pump 30 on the second conduit group 34 is a second flow control valve 42. Between the pump 30 and the aft outer exhaust slots 26, there is a third flow control valve 44. Between the pump 30 and the aft inner exhaust slots 28, there is a fourth flow control valve 46. A controller 47 associated with each pump 30 controls pump speed and manipulates valves 40, 42, 44 and 46 to control flow through each of the conduits 32, 34, 36 and 38 associated with the given pump 30. The inner surface 20 is generally hydrodynamically shaped and the profile extends outward from the aft inner exhaust slot 28 to a rounded circumferential trailing edge 48. The trailing edge 48 is shaped to a rounded profile as shown so that flow around the tail region does not result in separated flow at any operating condition. Alternately, this trailing edge can have a more traditional, sharp trailing edge as shown by broken lines 50. It will also be observed that the outer surface 18 has a length 52 (FIG. 1) and the inner side has a length 54 (FIG. 1) and that this inner length 54 is greater than the outer length 52. The fluid conveying means described above are preferably housed in a separable tubular end-piece 56 in the tubular body 10 with the end-piece having eight circumferential forward and aft slots in its inner surface 20 and eight circumferential forward and aft slots in its outer surface 18. It will also be appreciated that in the fluid adjacent the outer and inner peripheral surfaces that an outer fluid boundary layer 58 and inner fluid boundary layer 60 will naturally form. Referring particularly to FIG. 1, a typical wake trajectory forms at 62. If the device is used only employing outer suction to inner exhaust, the wake trajectory will be formed as at 64. If the device is used only employing inner suction to outer exhaust, the wake trajectory will be formed as at 66. Alternatively, the two suction and two exhaust slots associated with a given pump can be sub-divided into additional subslots in the circumferential direction to spread and diffuse the flow and thereby further reduce control system noise levels. The subslots are connected through the control valves and to the pump via a shaped ducting or other moldable material.

The device of the present invention allows stagnation point control via suction and ejection of boundary layer fluid, suction and ejection ducting used for fluid transfer on a hollow body, variable valves and pumps used to transfer fluid between body surfaces, and elimination of traditional appendage control surfaces. Those skilled in the art will also appreciate that this system allows for quick response for brisk maneuvers, eliminates the need for appendages which create noise and reduce interior volume, eliminates the need for a ballast system which creates noise and reduces interior volume, quiets propulsor operation, and provides for a hovering capability.

A number of other alternative embodiments will also be apparent to those skilled in the art. For example, it would be possible to install the ducting, pumps and valves in the nose section of the vehicle as well as the aft section of the vehicle or duct to further increase the effectiveness for brisk maneuvers and hovering. This arrangement, however, would reduce the usable volume within the vehicle body or duct.

It will also be understood that the present invention is a device used to maneuver a vehicle consisting of a tubular body with a longitudinal axis and outer and inner surfaces which generate natural fluid boundary layers when traveling through a fluid medium. Fluid is then conveyed between the outer and inner boundary layers to produce pressures on the tubular body which are non-symmetrical with respect to the longitudinal axis of the tubular body.

Although the invention has been described with a certain degree of particularity, it is to be understood that the present disclosure has been made only as an example and that the scope of the invention is defined as what is disclosed hereafter.

What is claimed is:

1. A device for maneuvering a vehicle immersed in a fluid medium comprising:

a tubular body having a longitudinal axis and outer and inner peripheral surfaces;

a plurality of maneuvering means circumferentially arranged on the tubular body for conveying fluid between said outer and inner peripheral surfaces; and a controlling means joined to said maneuvering means for controlling the conveying of fluid between said outer and inner peripheral surfaces to produce pressure on the tubular body which is asymmetrical with respect to the longitudinal axis of the tubular body.

2. The device of claim 1 wherein:

said tubular body has a forward end, an aft end, a plurality of fluid exhaust slots circumferentially arranged about the aft end on the outer peripheral surface, a plurality of fluid exhaust slots circumferentially arranged adjacent the aft end on the inner peripheral surface, a plurality of forward fluid suction slots circumferentially arranged on the outer peripheral surface, and a plurality of fluid suction slots circumferentially arranged on the inner peripheral side of the body; and said maneuvering means further comprising inner fluid conveying means connecting the fluid exhaust slots adjacent the aft end on the outer peripheral surface with the forward fluid suction slots on the inner peripheral surface and outer fluid conveying means connecting the fluid exhaust slots adjacent the aft end on the inner peripheral surface with the forward fluid suction slots on the outer peripheral surface.

3. The device of claim 2 wherein said maneuvering means further comprises pumping means disposed in said inner fluid conveying means and outer conveying means to move fluid from the fluid suction slots to the fluid exhaust slots.

4. The device of claim 3 wherein fluid flow control means are provided on the inner and outer fluid conveying means.

5. The device of claim 3 wherein suction is applied by the pumping means at the suction slots.

6. The device of claim 4 wherein said maneuvering means comprises a first group of conduits extending from the forward suction slots on the outer surface to the pumping means, a second group of conduits extending from forward suction slots on the inner surface to the pumping means, a third group of conduits extending from the pumping means to the aft exhaust slots on the outer surface and a fourth group of conduits extending from the pumping means to the aft exhaust slots on the inner surface.

7. The device of claim 6 wherein said fluid control means comprise a first flow control valve positioned on each of the first group of conduits, a second flow control valve positioned on each of the second group of conduits, a third control valve positioned on each of the third group of conduits and a fourth control valve positioned on each of the fourth group of conduits.

8. The device of claim 7 wherein the outer peripheral surface has an outer length and the inner peripheral surface has an inner length, with the inner length being different from the outer length.

9. The device of claim 8 wherein the inner peripheral surface has a generally hydrodynamically efficient shape.

10. The device of claim 9 wherein the inner peripheral surface extends outwardly and rearwardly from the aft exhaust slot on the inner peripheral surface.

11. The device of claim 10 wherein the outer peripheral surface extends rearwardly from the aft exhaust slots on the outer peripheral surface.

12. The device of claim 11 wherein the outer and inner peripheral surfaces converge in a circumferential trailing edge.

13. The device of claim 12 wherein the circumferential trailing edge has a rounded edge.

14. The device of claim 12 wherein the circumferential trailing edge has a sharp edge.

15. The device of claim 1 wherein the device is positioned on an aft end of the vehicle to be maneuvered.

16. The device of claim 1 wherein the device is positioned forward on an end of the vehicle to be maneuvered.

17. The device of claim 1 wherein the tubular body is cylindrical.

18. The device of claim 1 wherein the vehicle is a submersible vehicle.

19. The device of claim 18 wherein the vehicle is an unmanned undersea vehicle (UUV).

* * * * *